US007049766B2

(12) United States Patent
Lewis et al.

(10) Patent No.: US 7,049,766 B2
(45) Date of Patent: May 23, 2006

(54) LIQUID-ACTIVATED LIGHTED ICE CUBE

(75) Inventors: Edward D. Lewis, Brownsburg, IN (US); Christopher A. Webber, Indianapolis, IN (US)

(73) Assignee: Buztronics, Inc., Indianapolis, IN (US)

( * ) Notice: Subject to any disclaimer, the term of this patent is extended or adjusted under 35 U.S.C. 154(b) by 59 days.

(21) Appl. No.: 10/720,737

(22) Filed: Nov. 24, 2003

(65) Prior Publication Data

US 2004/0130886 A1 Jul. 8, 2004

Related U.S. Application Data

(60) Provisional application No. 60/428,391, filed on Nov. 22, 2002.

(51) Int. Cl.
*H05B 37/02* (2006.01)
*H01K 7/00* (2006.01)
*F21V 23/00* (2006.01)

(52) U.S. Cl. ..... 315/291; 315/76; 315/127; 362/101; 362/96

(58) Field of Classification Search ..... 315/76, 315/127, 128, 185 S; 362/101, 96
See application file for complete search history.

(56) References Cited

U.S. PATENT DOCUMENTS

| | | | | |
|---|---|---|---|---|
| 740,847 | A | 10/1903 | Glebsattel | 62/530 |
| 3,720,426 | A | 3/1973 | Johnston | 280/150 AB |
| 3,935,669 | A | 2/1976 | Potrzuski et al. | 46/228 |
| 3,948,523 | A | 4/1976 | Michael | 273/106 B |
| 4,325,230 | A | 4/1982 | Driscoll et al. | 62/293 |
| 4,554,189 | A | 11/1985 | Marshall | 428/11 |
| 4,869,699 | A | 9/1989 | Plambeck et al. | 446/47 |
| 4,929,212 | A | 5/1990 | Li | 446/47 |
| 5,603,219 | A | 2/1997 | Kolb | 62/1 |
| 5,839,814 | A | 11/1998 | Roberts | 362/78 |
| 5,903,212 | A | 5/1999 | Rodgers | 340/309.15 |
| 5,929,571 | A * | 7/1999 | Pauly | 315/127 |
| 6,416,198 | B1 * | 7/2002 | Vanderschuit | 362/101 |
| 6,669,352 | B1 * | 12/2003 | McKinney | 362/158 |
| 2003/0026088 | A1 | 2/2003 | Vanderschuit | 362/101 |
| 2003/0090897 | A1 | 5/2003 | Su | 362/186 |
| 2004/0208001 | A1 * | 10/2004 | Liu | 362/200 |
| 2005/0180146 | A1 * | 8/2005 | VanderSchuit | 362/367 |

OTHER PUBLICATIONS

TOPS Malibu products [online]; undated, (1 page) [retrieved on Mar. 11, 2002] Retrieved from the Internet: <http://www.topsmalibu.com/>.
*Solutions Catalog*, Late Spring 2002, p. 20.

* cited by examiner

*Primary Examiner*—Trinh Vo Dinh
(74) *Attorney, Agent, or Firm*—William F. Bahret

(57) ABSTRACT

A liquid-activated lighted ice cube includes a battery-powered electrical circuit and LED housed in a hollow body that resembles an ice cube. The circuit includes electrodes exposed to the exterior of the hollow body that, when in contact with water or other liquid beverage, cause the circuit to turn on the LED and illuminate the beverage.

10 Claims, 3 Drawing Sheets

LIQUID-ACTIVATED LIGHTED ICE CUBE

CROSS-REFERENCE TO RELATED APPLICATION

This application claims the benefit of U.S. Provisional Patent Application Ser. No. 60/428,391, filed Nov. 22, 2002, which application is hereby incorporated by reference.

BACKGROUND OF THE INVENTION

This invention relates generally to artificial ice cubes and more particularly to artificial ice cubes with internal illumination.

A variety of objects have been configured to resemble an ice cube of the type customarily used to cool a beverage in a hand-held container such as a glass. Some have been intended to cool the beverage without diluting it, while others have been designed to generate light or sound effects. Examples of such objects may be found in the following patents:

| Patent No. | Inventor | Issue Date |
|---|---|---|
| 740,847 | Glebsattel | Oct. 6, 1903 |
| 4,325,230 | Driscoll et al | Apr. 20, 1982 |
| 4,554,189 | Marshall | Nov. 19, 1985 |
| 5,603,219 | Kolb | Feb. 18, 1997 |
| 5,903,212 | Rodgers | May 11, 1999 |

SUMMARY OF THE INVENTION

The present invention provides a liquid-activated lighted artificial ice cube having a low-power, self-contained light circuit. In one embodiment the circuit includes a battery, one or more LEDs, an integrated circuit and a pair of spaced electrodes or contacts that are exposed to the exterior of the cube. When the artificial ice cube is immersed in water or other liquid beverage in the manner of an ordinary ice cube, the liquid completes the circuit between the exposed electrodes and thereby triggers the IC which then supplies power to the LED(s).

DETAILED DESCRIPTION OF PREFERRED EMBODIMENTS

Figure 1:
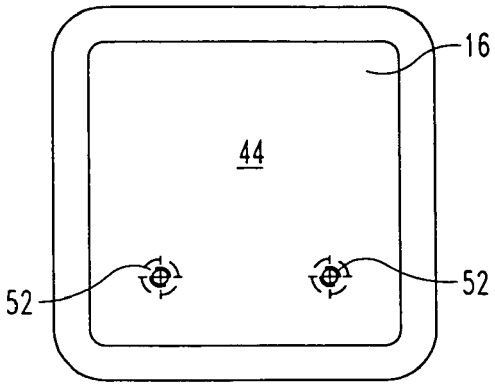
FIG. 1 is a top plan view of a preferred embodiment of a liquid-activated lighted ice cube according to the present invention.
Figure 3:
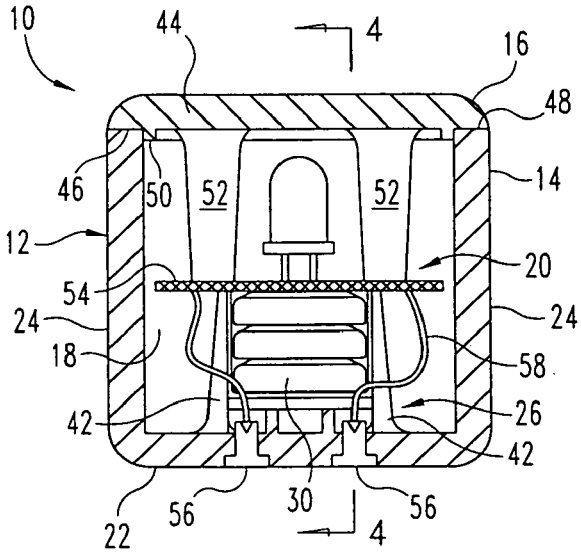
FIG. 3 is a cross-sectional view of the ice cube of FIG. 1, taken along plane 3—3 of FIG. 2 and viewed in the direction of the arrows.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

Referring to FIGS. 1–4, one embodiment of a liquid-activated lighted artificial ice cube 10 of the present invention includes a hollow body 12 that is generally in the shape of a cube, but can be made in other shapes that are suggestive of a piece of ice used to cool beverages. Preferably, hollow body 12 is constructed of a transparent or translucent thermosetting plastic material that can be molded to the desired shape, and includes a first portion 14 mating with a second portion 16. First and second portions 14 and 16 are preferably welded or cemented together to form an hermetically sealed enclosed space 18 which contains a light circuit 20 to be described below.

For convenience and to provide a consistent frame of reference for description purposes, various directional terms, e.g., horizontal, vertical, bottom, top, side, upward, downward and the like, will be used to describe the orientation of various components of ice cube 10 relative to each other. The invention is not restricted to the described orientation. Unless described otherwise, the ice cube 10 can be used in any orientation in the same manner as a real ice cube.

First portion 14 of hollow body 12 includes a bottom wall 22 and four side walls 24 that are substantially perpendicular to bottom wall 22 and extend upward therefrom. The four side walls 24 are integrally joined together at four vertical corners and are integrally joined to the bottom wall 22 about the periphery thereof to form an open-topped box or cubic container having walls that surround the substantially cubic hollow space 18 on five sides.

Figure 2:
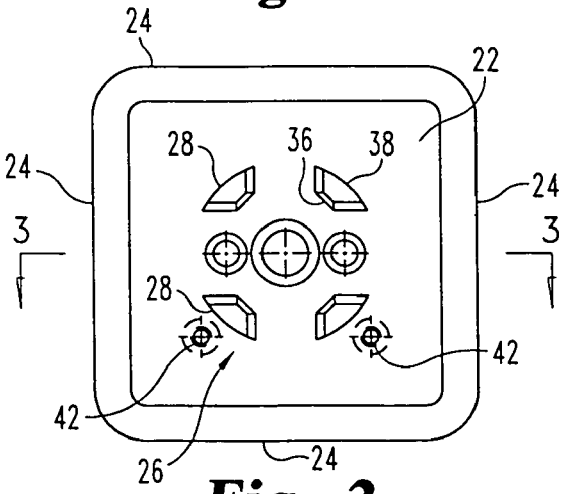
FIG. 2 is a bottom plan view of the ice cube of FIG. 1.

Extending upward from bottom wall 22 within hollow space 18 is a battery holder 26 comprising four posts or standoffs 28 sized to hold three stacked button cells 30 and having a height approximately one half the vertical height of enclosed space 18. Each post includes an arcuate inner surface 36 and an arcuate outer surface 38 as best shown in FIG. 2. The ice cube also includes a pair of spaced, upwardly tapered standoffs 42 which are integral with bottom wall 22 and extend therefrom in cantilever fashion. Standoffs 42 each have a height approximately equal to that of battery holder 26. They are spaced from side walls 24 and from battery holder 26 as shown in FIG. 2 and are approximately centered in adjacent quadrants of bottom wall 22.

Second portion 16 of hollow body 12 includes a top wall 44 having a thickness substantially equal to that of side walls 24 and sized to mate with and close the open-topped cubic container formed by bottom wall 22 and side walls 24, thereby fully enclosing space 18. In one embodiment, the bottom surface 46 of top wall 44 is substantially planar to mate flatly against planar top surface 48 of side walls 24, and a perimetrical lip 50 extends downwardly from bottom surface 46 and fits inside of side walls 24 to assure alignment of portions 14 and 16 of ice cube body 12. The interface between portions 14 and 16 defined by surfaces 46 and 48 is sealed by thermal or chemical welding of the plastic material, or by use of cement, to hermetically seal enclosed space 18. In another embodiment, the top wall is ultrasonically welded to the side walls. Top wall 44 has no lip 50 in this embodiment, and the interface defined by surfaces 46 and 48 is provided with a weld bead to facilitate ultrasonic welding. For example, one of the surfaces may be grooved and the other surface provided with a mating ridge.

Figure 4:
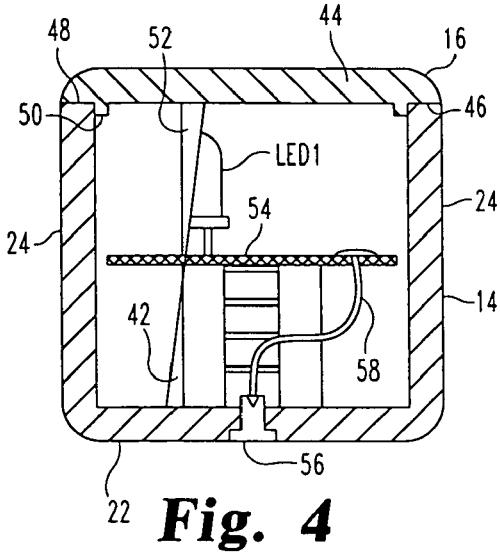
FIG. 4 is a cross-sectional view of the ice cube of FIG. 1, taken along plane 4—4 of FIG. 3 and viewed in the direction of the arrows.

A pair of spaced standoffs 52 is integral with and extends downward from top wall 44 in cantilever fashion, in vertical alignment with the pair of standoffs 42 on bottom wall 22 as illustrated in FIG. 4. The length of standoffs 52 is selected to leave a small gap between the lower ends thereof and the top ends of standoffs 42 when ice cube 10 is assembled. The gap is just wide enough to accommodate the thickness of a printed circuit board 54 sandwiched between standoffs 52 and standoffs 42.

Printed circuit board 54 is sized and shaped to fit within enclosed space 18 while disposed substantially parallel to bottom wall 22 of first portion 14. Printed circuit board 54 is substantially constrained against vertical downward movement by battery holder 26 and standoffs 42 upon which printed circuit board 54 rests. Standoffs 52 substantially constrain circuit board 54 against vertical upward movement, and side walls 24 provide substantial constraint against horizontal movement.

Figure 5:
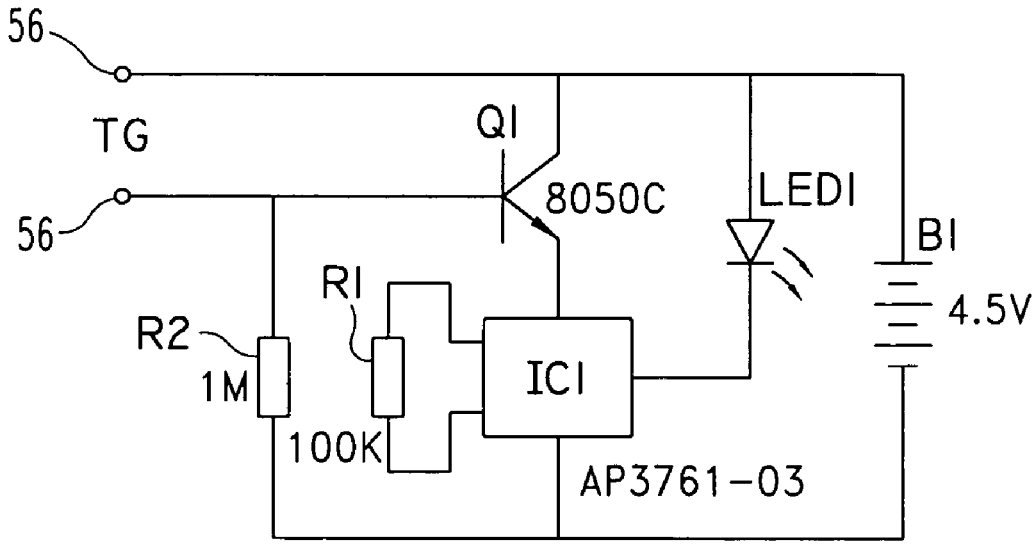
FIG. 5 is an electrical schematic of a light circuit contained within the ice cube of FIG. 1.

Referring to FIG. 5, one embodiment of a light circuit 20 suitable for use within the ice cube includes an integrated circuit IC1, resistors R1 and R2, transistor Q1, LED1 and battery power source B1 interconnected as shown in the schematic and as further described herein. Also included is a pair of spaced electrodes 56 imbedded in bottom wall 22 and exposed to the exterior of hollow body 12 as switch contacts. A suitable LED is commercially available from Chi Ban Electronics Company Limited, Shenzhen, China, as part number 5X3VC, where the letter "X" designates the color, e.g., "R" for red, "G" for green, and "W" for white. The IC is preferably in die form and may be an AP3761-03 IC commercially available from Advanced Microelectronic Products, Inc., Taiwan. It is mounted on the circuit board along with transistor Q1 and resistors R1 and R2, and its power supply input is connected to the emitter of Q1 which thereby controls the supply of power to the IC. The IC has an output connected to the cathode of the LED as shown. Resistor R1 controls the clock frequency of the IC and resistor R2 is a pull-down resistor provided to hold the transistor off when the base thereof is open. Electrodes 56 are preferably constructed of a corrosion-resistant metal alloy such as brass or stainless steel, as they are intended to contact water, ethyl alcohol and other liquids and substances commonly found in beverages. Nickel-plated copper is particularly suitable. A pair of wires 58 connects electrodes 56 to the battery positive terminal and to the base of transistor Q1. Thus, when a conductive liquid path is provided between the electrodes such as from immersion of the ice cube in a drink, it completes a circuit between the battery and the base of the transistor and thereby causes the transistor to turn on and supply power to the IC.

The IC may be wire bonded to operate in a "Lever Hold" mode whereby the LED output is held low, and the LED is thereby held on, whenever the switch defined by electrodes 56 is closed. When the switch is opened, power is immediately removed from the IC and the LED is thus turned off, whereby the circuit is completely deenergized. The IC is immediately retriggered and the LED turned on when the switch is closed again.

The AP3761-03 IC may alternatively be wire bonded to operate in a stable mode, thereby causing continuous flashing of the LED, whenever the switch is closed.

In a less preferred alternative embodiment, the IC is continually supplied with power and a transistor is provided between the switch and a trigger input of the IC, which is configured to operate in a retriggerable one-shot mode such that it is triggered when the switch first closes upon contact with liquid and is retriggered as long as the ice cube remains wet. The one-shot times out, and thus the LED turns off, a set period of time after the switch is opened, that is, a set period of time after the drink is finished or the ice cube is removed from the glass.

In another embodiment, the LED is a UV LED and the plastic body of the ice cube is made fluorescent, either by means of a fluorescent pigment mixed into the plastic resin prior to formation of the cube or by means of a fluorescent coating applied to the inner surface and/or outer surface thereof. The LED preferably has a peak wavelength of 400 nm ±10 nm. A suitable LED with such a wavelength is the DL50PLDW503 UV LED from Shue Kwong Optic Electronic Company, Shenzhen, China. The fluorescent pigment may be one of the following pigments commercially available from Wen Lee Plastic Pigment Company, Tungguong, China: P/N 61113 (green), P/N 31461 (blue), P/N 238 (red), and P/N 2600(yellow). The pigment may be mixed into the plastic with a mix ratio of about 1–2 grams pigment per one kilogram of plastic. The plastic body of the cube may be formed of polycarbonate mixed with such a pigment and injection molded. Alternatively, the cube may be formed of polystyrene, PVC, ABS or acrylic.

It will be appreciated by those skilled in the art that the weight of the batteries in the lower half of the ice cube tends to keep the LED side up and also tends to keep the electrodes wet, and thereby keep the LED on, when the ice cube is floating in a glass.

Figure 6:
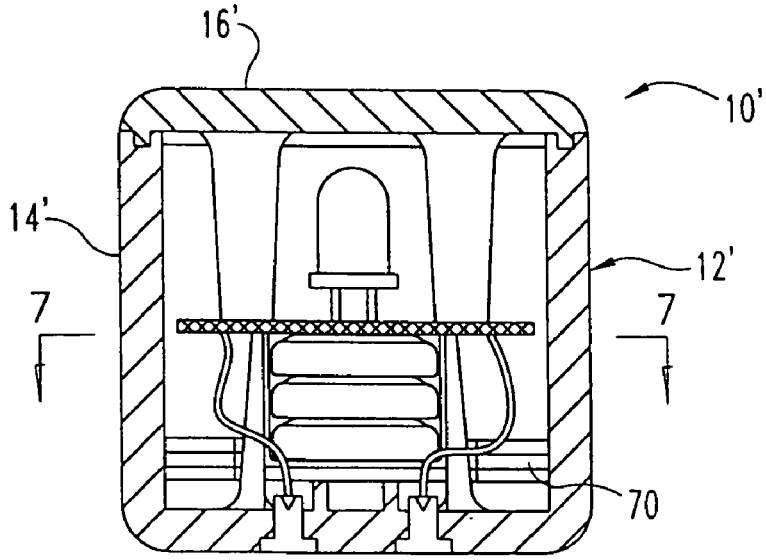
FIG. 6 is a cross-sectional view of another embodiment of a liquid-activated lighted ice cube according to the present invention, similar to the view of FIG. 3.
Figure 7:
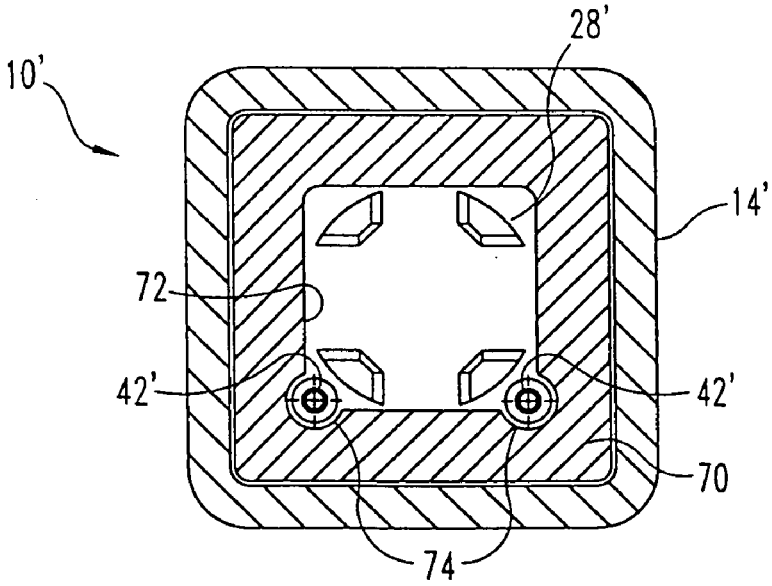
FIG. 7 is a cross-sectional view of the ice cube of FIG. 6, taken along lines 7—7.

Referring to FIGS. 6 and 7, an alternative embodiment is shown that is substantially the same as the embodiment of FIGS. 1–5, except for the addition of a weight 70. For a description of the other components of the embodiment of FIGS. 6 and 7, indicated by like primed reference numerals, reference should be made to the description above of the embodiment of FIGS. 1–5. Weight 70 can be made of iron or steel or other suitably dense material, and is shaped generally as a square flat plate, or stack of plates, having a generally square opening 72 in the center. Posts 28' protrude through opening 72. Two comers of the opening 72 include cutouts 74 to provide clearance for standoffs 42'. The mass of weight 70 is selected such that, in combination with the weight of the batteries, the artificial ice cube tends to float substantially submerged, with the top of the ice cube approximately level with the surface of the liquid in which it is immersed, much like the floating characteristics of a real ice cube While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

We claim:

1. A liquid-activated lighted artificial ice cube, comprising:

a hollow body;

a pair of electrodes exposed on the exterior of said hollow body;

an electronic circuit disposed within said hollow body, said circuit including a battery, an LED, an active circuit element controlling current between said battery and said LED, an electronic switch responsive to current flowing through a conductive liquid path between said electrodes for controlling current between said battery and said active circuit element, said electronic switch being connected to said pair of electrodes;

wherein said electronic switch disconnects said active circuit element from said battery in the absence of a conductive liquid path between said electrodes and thereby deenergizes the entire circuit.

2. The ice cube of claim 1, wherein said active circuit element is an integrated circuit.

3. The ice cube of claim 2, wherein said electronic switch is a transistor.

4. The ice cube of claim 3, wherein said active circuit element provides current to said LED such that said LED is held on continuously while current flows through a conductive liquid path between said electrodes.

5. The ice cube of claim 3, wherein said active circuit element provides current to said LED intermittently such that said LED flashes while current flows through a conductive liquid path between said electrodes.

6. The ice cube of claim 4, wherein said active circuit element interrupts current to said LED such that said LED is turned off in the absence of a conductive liquid path between said electrodes.

7. The ice cube of claim 4, wherein said active circuit element interrupts current to said LED such that said LED is turned off a set period of time after removal of a conductive liquid path between said electrodes.

8. The ice cube of claim 1, wherein said electronic switch is a transistor.

9. The ice cube of claim 1, wherein said active circuit element provides current to said LED such that said LED is held on continuously while current flows through a conductive liquid path between said electrodes.

10. The ice cube of claim 1, wherein said active circuit element provides current to said LED intermittently such that said LED flashes while current flows through a conductive liquid path between said electrodes.

* * * * *

UNITED STATES PATENT AND TRADEMARK OFFICE

CERTIFICATE OF CORRECTION

PATENT NO. : 7,049,766 B2
APPLICATION NO. : 10/720737
DATED : May 23, 2006
INVENTOR(S) : Edward D. Lewis et al.

It is certified that error appears in the above-identified patent and that said Letters Patent is hereby corrected as shown below:

In column 3, line 66, please change “a stable” to --astable--

Signed and Sealed this

Eighth Day of May, 2007

JON W. DUDAS
*Director of the United States Patent and Trademark Office*